US005873416A

United States Patent [19]

Horton, III

[11] Patent Number: 5,873,416

[45] Date of Patent: Feb. 23, 1999

[54] DRILLING, PRODUCTION, TEST, AND OIL STORAGE CAISSON

[75] Inventor: Edward E. Horton, III, Rancho Palos Verdes, Calif.

[73] Assignee: Deep Oil Technology, Incorporated, Houston, Tex.

[21] Appl. No.: 931,978

[22] Filed: Sep. 17, 1997

Related U.S. Application Data

[62] Division of Ser. No. 564,830, Nov. 29, 1995, Pat. No. 5,706,897.

[51] Int. Cl.[6] ..... E21B 34/04

[52] U.S. Cl. ..... 166/344; 166/368

[58] Field of Search ..... 166/368, 344, 166/345, 351, 360, 343, 347

[56] References Cited

U.S. PATENT DOCUMENTS 4,544,036 10/1985 Saliger ..... 166/343 X
4,607,701 8/1986 Gundersen ..... 166/368
4,629,003 12/1986 Baugh ..... 166/347 X
4,754,813 7/1988 Jennings et al. ..... 166/344

*Primary Examiner*—William Neuder
*Attorney, Agent, or Firm*—Robert J. Edwards; D. Neil LaHaye

[57] ABSTRACT

A drilling, production, test, and oil storage caisson for use in deep water offshore well operations. Separate low pressure and high pressure drilling risers are independently supported on buoyancy modules. Multiple drilling and production risers are left in the water and connected to the drilling rig and well(s) as needed to prevent the need for the raising and lowering of different risers during the various steps involved in beginning and completing wells. Surface and lower BOP stacks are utilized. Means for controlling the accelerations and velocity of the drilling riser buoyancy modules in the event of riser failure is provided. A subsea tree with dual master valves allows for production directly through a vertical production riser, flowline, to the production manifold on the caisson. A twisted tubing production riser is formed from three strings of tubing that are used for the flowline, annulus, and conduit for control lines.

1 Claim, 9 Drawing Sheets

DRILLING, PRODUCTION, TEST, AND OIL STORAGE CAISSON

This application is a division of application Ser. No. 08/564,830, filed Nov. 29, 1995, now U.S. Pat. No. 5,706,897.

BACKGROUND OF THE INVENTION

1. Field of the Invention

The invention is generally related to structures used offshore in the drilling and production of hydrocarbons and more particularly to floating caissons used in such operations.

2. General Background

In the offshore drilling industry, there are many operational issues and difficulties that must be addressed. A conventional subsea BOP (blow-out-preventer) stack riser is large and heavy and normally requires syntactic foam for additional buoyancy. This results in an overall diameter of forty-two inches, which presents a relatively large area that is readily affected by current loads, causing a substantial lateral offset between the surface and the seafloor. Drilling risers are normally supported on hydraulic tensioners with pneumatic accumulators to provide a relatively constant tension variation with stroke. These tensioners are expensive and limited in capacity. Further, because they are mechanical and use wire rope, one hundred percent redundancy is needed. Offshore drilling operations from a floating vessel are normally carried out with a subsea BOP stack in conjunction with a riser that carries the mud returns back to the surface. Alternatively, the pressure risers have been used with the BOP stack on the surface and no shut off mechanism at the seafloor. The first configuration locates complicated and expensive equipment at the seafloor while the second configuration has the disadvantage of no shut off mechanism at the seafloor.

SUMMARY OF THE INVENTION

The invention addresses the above shortcomings in the known art. What is provided is a drilling, production, test, or oil storage caisson for use in deep water offshore well operations. The invention includes separate low pressure and high pressure drilling risers that are independently supported on buoyancy modules, a majority of which are located at the surface. Multiple drilling and production risers are left in the water and connected to the drilling rig and well(s) as needed to prevent the need for the raising and lowering of different risers during the various steps involved in beginning and completing wells. A split BOP stack is utilized wherein a surface BOP stack controls well kicks and other normal well functions and a lower BOP stack serves as an emergency and last resort function to shut off the well. The simpler lower BOP stack allows the use of a marine connector above the lower BOP stack to provide for quick disconnect of the risers in the caisson in the event of an emergency. Means for controlling the accelerations and velocity of the drilling riser buoyancy modules in the event of riser failure is provided in the form of a combination dash pot and hydraulic cylinder or a disc brake. A subsea tree with dual master valves eliminates the need for a wing valve since the production goes directly through a vertical production riser, flowline, to the production manifold on the caisson. A twisted tubing production riser is formed from three strings of tubing that are used for the flowline, annulus, and conduit for control lines.

BRIEF DESCRIPTION OF THE DRAWINGS

For a further understanding of the nature and objects of the present invention reference should be made to the following description, taken in conjunction with the accompanying drawings in which like parts are given like reference numerals, and wherein.

DETAILED DESCRIPTION OF THE PREFERRED EMBODIMENT

Figure 1:
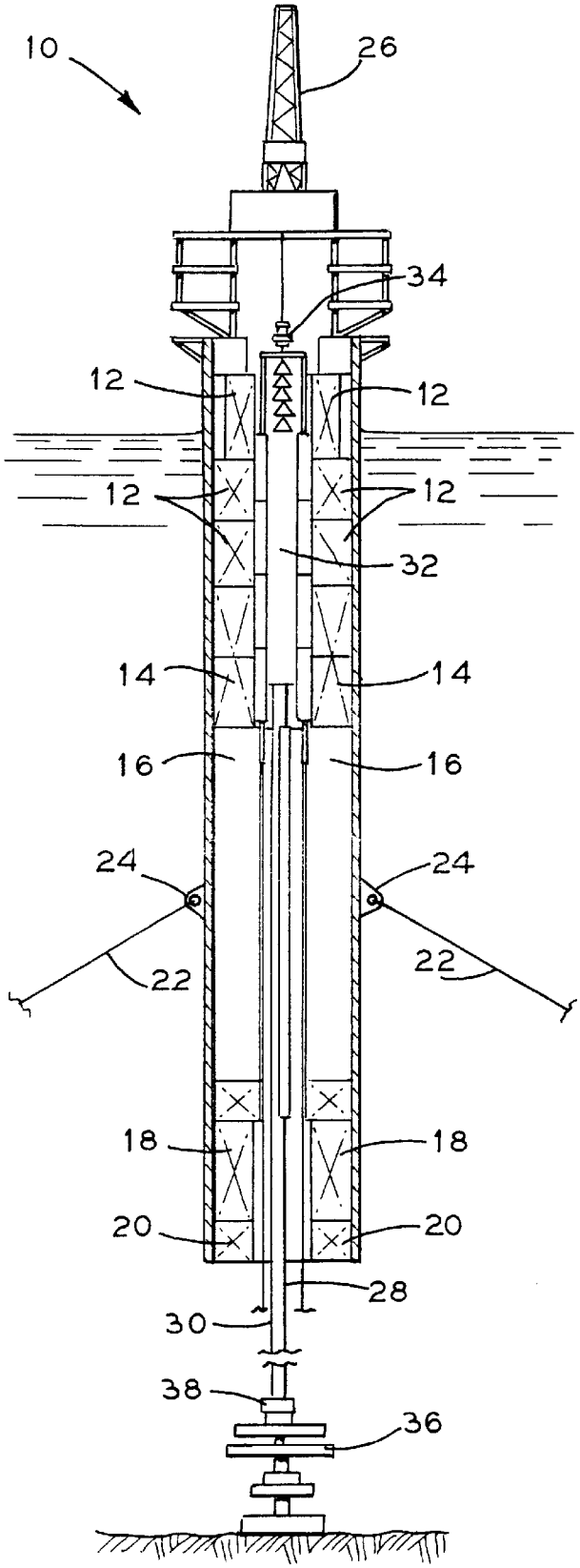
FIG. 1 is an elevation view of a caisson embodying the invention.
Figure 4:
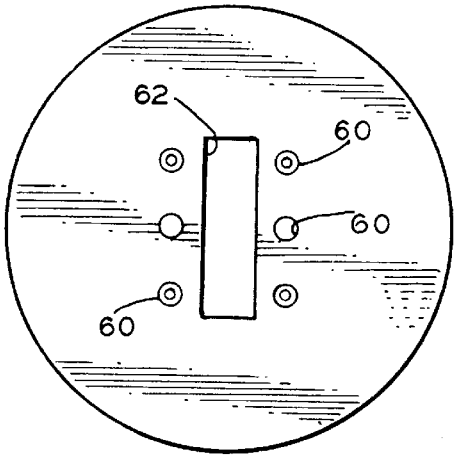
FIG. 4 is a cross section of the caisson that illustrates the multiple riser slots through the caisson.
Figure 6:
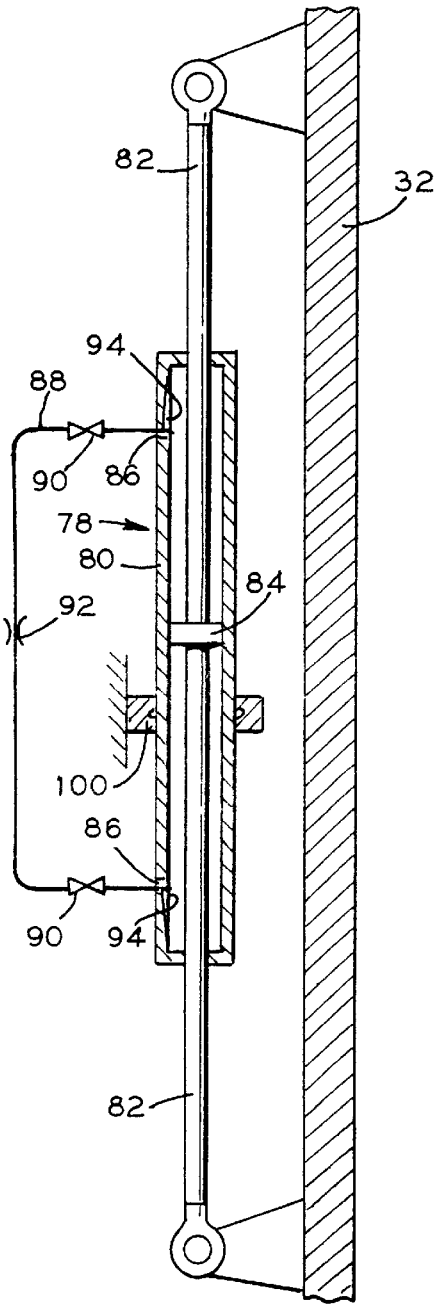
FIG. 6 is a detail view that illustrates a dashpot attached to the drilling riser buoyancy module.
Figure 7:
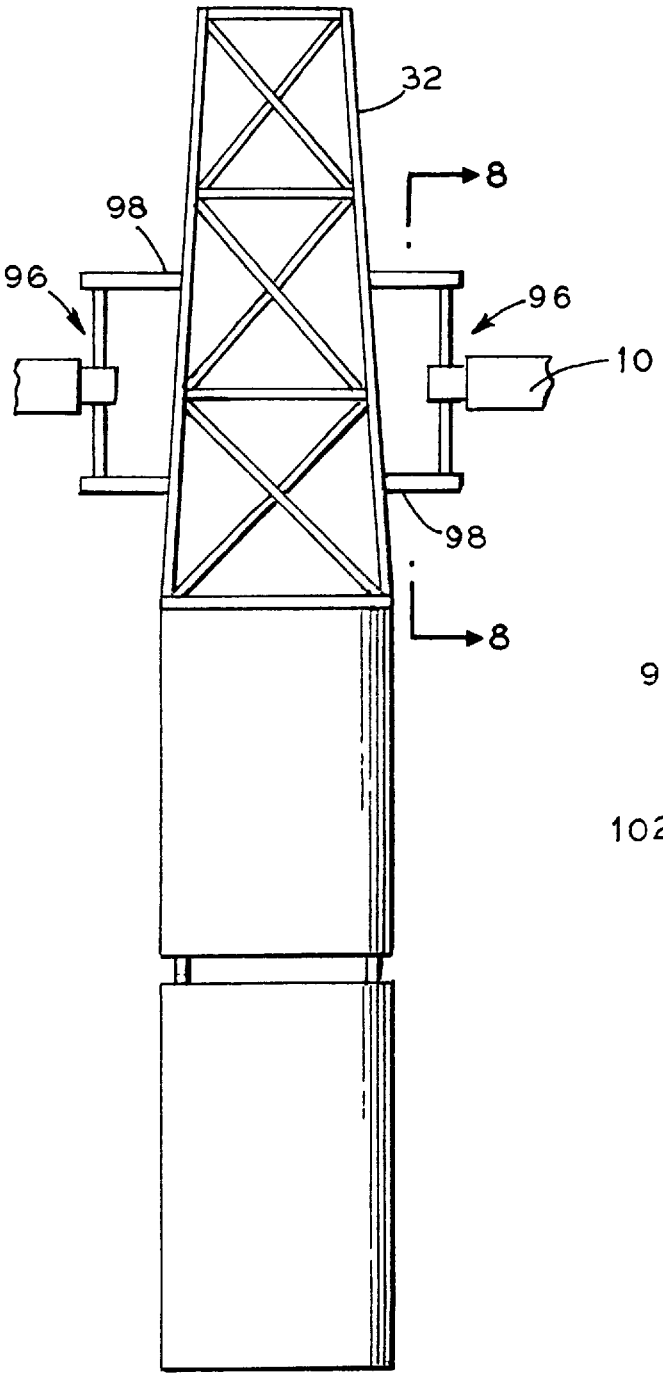
FIG. 7 is a detail view that illustrates a friction brake alternative to the dashpot of FIG. 6.
Figure 8:
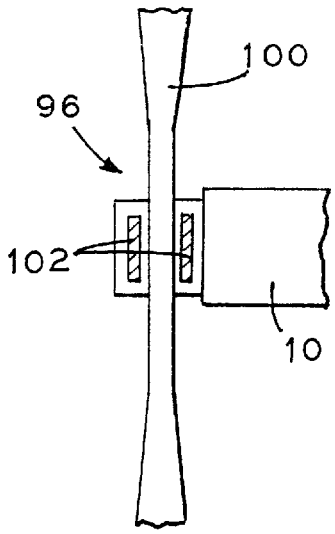
FIG. 8 is a view taken along lines 8—8 of FIG. 7.
Figure 9:
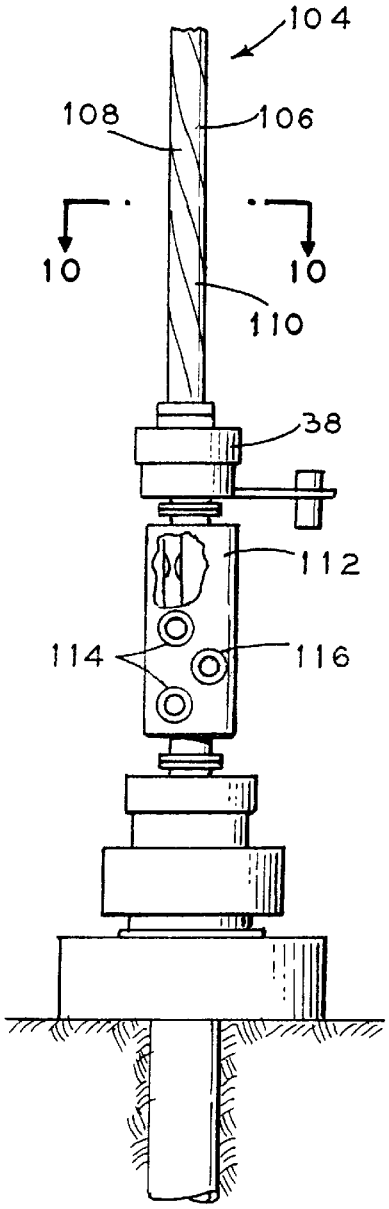
FIG. 9 illustrates the twisted tubing production riser and subsea tree.

Referring to the drawings, it is seen in FIG. 1 that the drilling, production, test, and oil storage caisson is generally indicated by the numeral 10. Although the basic structure of floating caissons is known as that described in U.S. Pat. No. 4,702,321, a general description of the structure of caisson 10 is provided for the sake of clarity. Caisson 10 is self buoyant by means of buoyancy tanks 12, may be of any suitable cross section, and is of uniform cross section throughout its length. Caisson 10 includes variable ballast 14, oil storage compartments 16, trim tanks 18, and fixed ballast tanks 20. Caisson 10 is held in position by mooring lines 22 which pass through mooring fairleads 24. Caisson 10 is designed to extend as much as six hundred feet below the surface of the water to provide the necessary stability. Drilling rig 26 is positioned on movable draw works on top of caisson 10 in a manner known in the art to allow selective positioning of the drilling rig relative to the different well locations at the seafloor. Caisson 10 includes a number of features not taught in known patents. Multiple drilling risers having different pressure ratings are generally indicated by numerals 28 and 30. The drilling risers are independently supported by buoyancy modules 32. As seen in FIG. 4, caisson 10 is provided with multiple slots through the length of the caisson to accommodate the multiple risers. Upper and lower BOP stacks 34 and 36 are provided, as opposed to a single upper or lower BOP stack commonly used. A marine connector 38 is provided at the lower end of each riser and the upper end of lower BOP stack 36 to provide for ease of connection and disconnection of the risers during different stages of work on the wells. Means illustrated in FIG. 6–8 are provided to control the acceleration and velocity of the drilling riser buoyancy modules 32 in the event of a riser failure. A twisted tubing production riser, seen in FIG. 9 and 10, may be utilized to provide for greater flexibility. FIG. 9 also illustrates a subsea tree that allows for a vertical flowline.

The drilling risers indicated in FIG. 1 comprise a low pressure riser 30 and a high pressure 28. The low pressure drilling riser 30 may have a nominal twenty-one inch outer diameter and nineteen and one-fourth inch inner diameter and be designed to withstand up to five thousand psi internal pressure. The high pressure drilling riser 28 may have a fifteen inch outer diameter and thirteen and five-eighth inch inner diameter and be designed to withstand up to ten thousand to fifteen thousand psi internal pressure. This allows the low pressure drilling riser 30 to be used to drill the upper portion of a well and the high pressure drilling riser 28 to be used to drill the lower portion of the well down to the complete well depth. The two riser concept provides the advantages of having drilling risers that are subject to reduced lateral current loads as a result of their smaller cross sections compared to that normally used. This is of significance when floating structures such as caisson 10 are used in deep waters such as five thousand feet or deeper. The diameter of the drilling risers given above are only examples of sizes that may be used, with the important aspect being that multiple drilling risers of different pressure ratings reduce the area of each riser subject to current induced loads.

Figure 2:
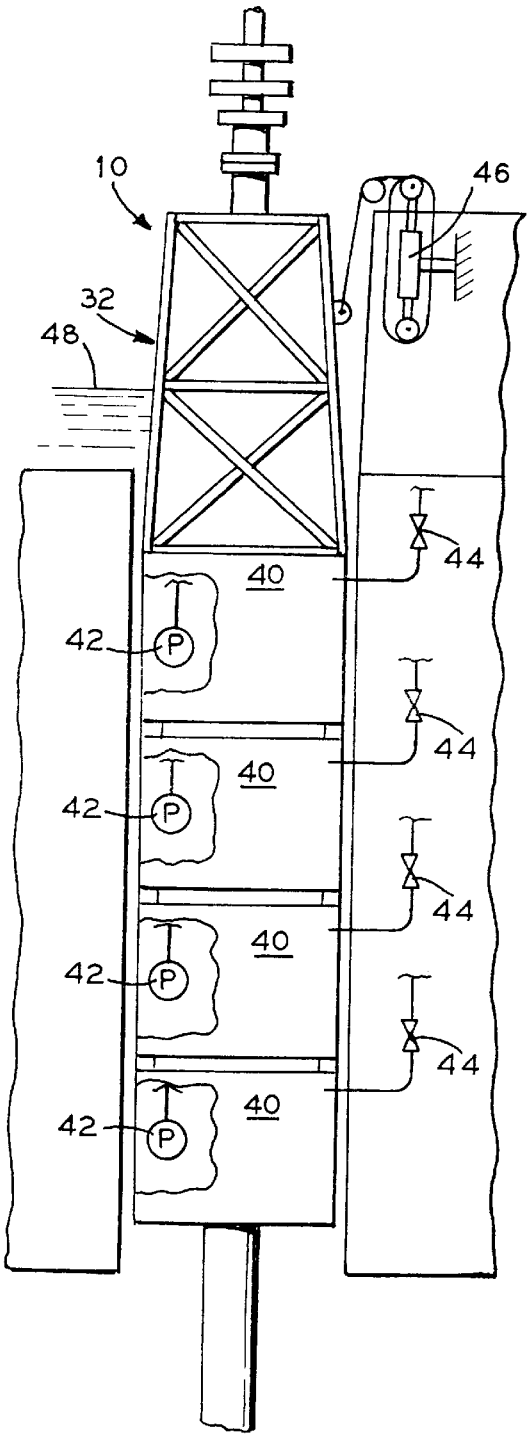
FIG. 2 is a detail view that illustrates a drilling riser buoyancy module.

Buoyancy modules 32 for drilling risers 28, 30 are illustrated in enlarged detail in FIG. 2. Since the tension required to support the drilling risers is variable due to changes in mud weight, means for varying the buoyancy of the drilling risers to accommodate the changing weight is required. A plurality of separate compartments 40 are each provided with a pump 42 and a control valve 44. The bottom of each compartment may be open to the sea water 48. Each pump 42 is used to pump water into or out of the respective compartment 40 that it is associated with. As an alternative each control valve 44 may be used to inject compressed air into or bleed air from the respective compartment 40 that it is associated with to force water out of the compartment or let water into the compartment. Pumps 42 and control valves 44 are used in this manner to vary the tension on the drilling riser to accommodate the changing weight of drilling mud in the drilling riser.

As an alternative or addition to the pumps 42 and control valves 44, one or more hydropneumatic tensioners 46 may be used to support the variable load of the mud weight. This would allow lower capacity, less expensive tensioners to be used in comparison to tensioners required to support the weight of the entire drill string. Tensioner 46 has a line attached to buoyancy module 32 and is operatively engaged with the tensioner in a manner known in the art.

Figure 3:
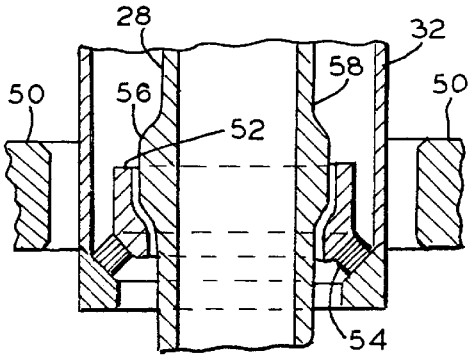
FIG. 3 is a detail side sectional view that illustrates the means for reducing the bending stress on the drilling riser.

As seen in FIG. 3, means for reducing the bending stress of the drilling risers at the keel of caisson 10 is provided by extending the lower stem of the buoyancy module 32 to pass through the keel constraint ring 50 at the bottom of the caisson 10. The inner diameter of the lower end of buoyancy module 32 is provided with a support ring 52 that is attached to buoyancy module 32 on a movable joint 54 so as to be movable within a limited range. Any suitable joint such as a universal, elastomeric, ball, or wobble joint may be used. A shoulder 56 is provided in drilling risers 28, 30 at a drilling riser tension joint 58. The shoulder 56 rests on support ring 52 and thus relieves axial tension on the drilling riser above the shoulder 56. This allows bending in the drilling riser above shoulder 56 where the axial tension is near zero and thus significantly reduces bending stress on the riser. Bending stress can also be further reduced by using a low modulus material such as titanium on a riser joint above the shoulder 56. Although support ring 52, movable joint 54, and shoulder 56 are described as a means of reducing bending stress on a drilling riser, it should be understood that the same configuration may also be used with a production riser and that a separate drawing should be unnecessary since a side section view of a production riser is essentially the same as that of a drilling riser.

As seen in FIG. 4, caisson 10 is adapted to handle multiple risers being in the water at the same time by the provision of a plurality of riser slots 60 through the length of the caisson that are sized to receive production or drilling risers. This allows all of the different types of risers that are used at different stages of well preparation, drilling, completion, and production to remain deployed while the drilling rig is shifted above the necessary slot at the upper end of the caisson 10. This results in time savings since it is not necessary to pull up several thousand feet of one type of riser before deploying a different type of riser. It should be understood that FIG. 4 is a cross section through the caisson 10 as it would appear from approximately two hundred twenty to five hundred feet below the water surface and should be considered as generally representative of the presence of the slots and not the exact construction of support structures along the entire length of the caisson 10. For example, a lower portion of the caisson may comprise a radial frame that includes circular slots that are coaxial with the slots at different levels in the caisson 10. The various structures that define the riser slots 60 are designed to provide lateral support to the deployed risers. The spacing of the riser slots 60 will depend upon the dimensions of the caisson 10. As an example, for a caisson having a diameter of ninety to one hundred feet, adjacent riser slots may be spaced fifteen to twenty-five feet apart. This should not be taken as an indication that the multiple well locations at the seafloor are limited to horizontal spacing that corresponds exactly to that of the riser slots in the caisson. The offset of the wells from the bottom of the caisson is directly related to water depth and allowable bending stress of the risers. As an example, for a water depth of five thousand feet and an allowable lateral excursion of five percent at the top of the riser, a circle having a two hundred fifty foot diameter for well sites on the seafloor is possible. This applies to each riser slot, which then results in an area on the seafloor having a larger diameter than two hundred fifty feet, depending on the spacing of the riser slots in the caisson.

The caisson 10 is also provided with a relatively large rectangular slot 62 in comparison to riser slots 60. For a caisson of the size referred to above, rectangular slot 62 may be twelve feet by forty feet. The rectangular slot 62 is useful for lowering equipment to the seafloor that is larger than the diameter of the riser slots 60. Once such equipment is lowered into position, the appropriate riser can be connected to the equipment.

Figure 5:
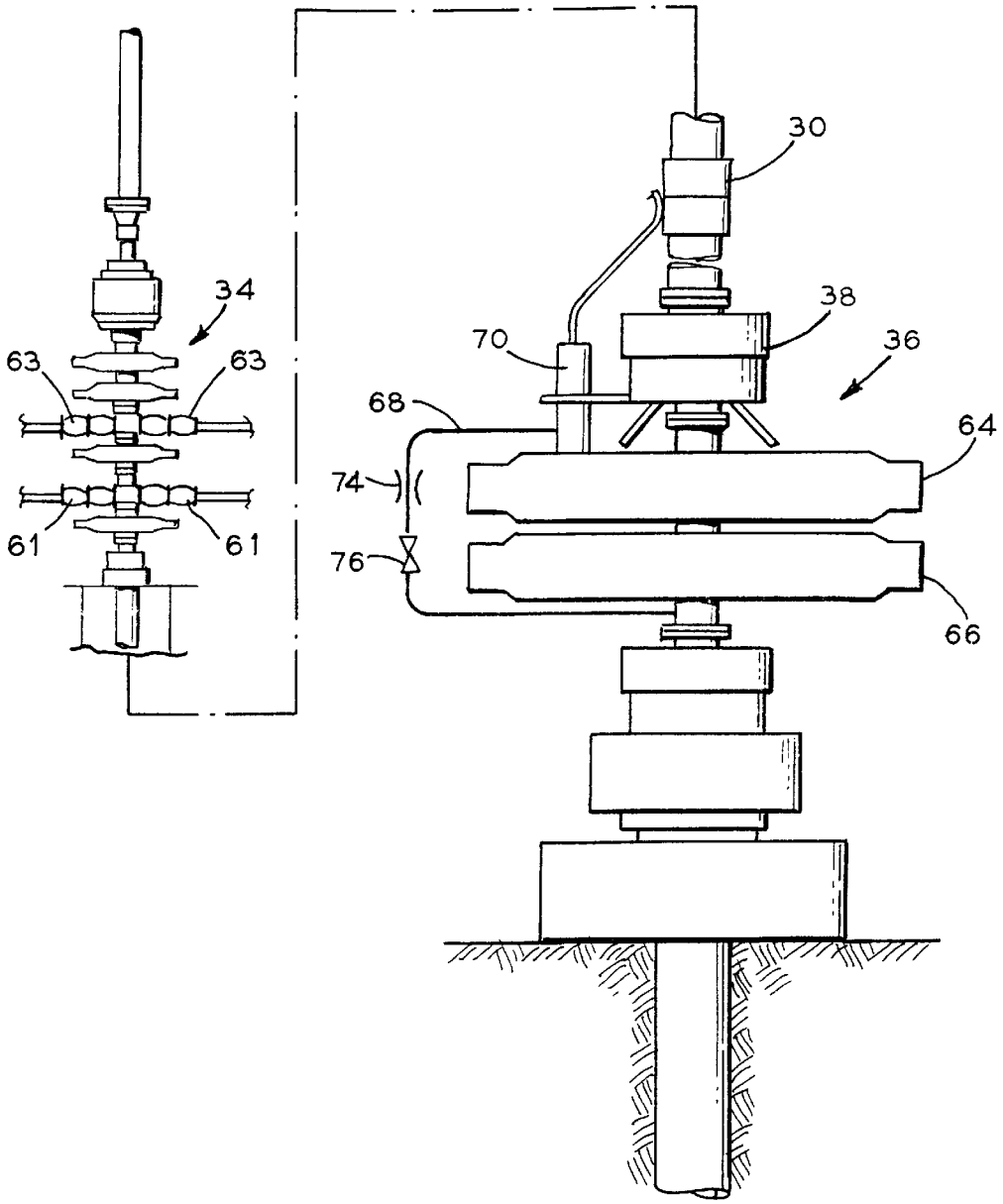
FIG. 5 is a detail view that illustrates the upper and lower BOP stacks.

FIG. 5 illustrates the upper and lower BOP stacks 34 and 36 with the low pressure drilling riser 30. Splitting the BOP stacks allows the kill and choke controls 61, 63 to be positioned in the lower portion of the surface BOP stack 34. This results in it being unnecessary to run the kill and choke lines down the sides of the riser and allows the riser to incorporate simple threaded connections. This also leads to a simpler lower BOP stack 36 that does not require the more sophisticated and complicated controls of the surface BOP stack. Lower BOP stack 36 comprises shear rams 64, pipe rams 66, and bleed line 68. Control mechanism 70 is used to cause marine connector 38 to remotely attach or detach the drilling riser 30 from the lower BOP stack 36. Shear rams 64 and pipe rams 66 are used to close and cut the tubing below the marine connector 38 in the event of an emergency requiring disconnection of the drilling riser 30. When reconnecting after an emergency disconnect, bleed line 68 allows fluid pressure below the rams 64, 66 to be equalized with the pressure riser at a controlled rate. The rate of pressure equalization is controlled by flow restrictor 74 and valve 76 in bleed line 68.

Means for controlling acceleration and velocity of the drilling riser buoyancy modules 32 in the event of a riser failure are illustrated in FIG. 6. Dashpot 78 has cylinder 80 attached to caisson 10 and rods 82 each attached at one end to drilling riser buoyancy module 32. piston 84 is attached to the opposing ends of rods 82 so that piston 84 is movable in cylinder 80. Cylinder 80 is provided with two bypass orifices 86 adjacent each end of the cylinder. Fluid line 88 is connected at each end to the bypass orifices 86. Fluid line 88 is provided with an isolation valve 90 adjacent each end and a flow restrictor 92 between the two isolation valves 90. If a drilling riser fails, the buoyancy module 32 would cause potentially damaging vertical acceleration of the drilling riser and cause damage to equipment. With rods 82 attached to the buoyancy module 32, the rods 82 move with the buoyancy module 32 and cause corresponding movement of piston 84. Fluid in cylinder 80, such as hydraulic fluid, is forced into fluid line 88 to the opposite side of the piston 84. Flow restrictor 92 controls the rate of fluid flow to limit the movement of buoyancy module 32 and the remaining drilling riser to a preselected rate. As the piston 84 passes either of the bypass orifices 86, a tapered groove 94 at each end of the cylinder allows fluid to flow past the piston to cause a controlled deceleration. Isolation valves 90 are normally open during routine operations but may be closed to prevent movement of buoyancy module 32 and its corresponding drilling riser during installation, removal, or maintenance work. Although only one dashpot assembly is shown for ease of illustration, it should be understood that a plurality of dashpot assemblies may be used.

FIG. 7 and 8 illustrate an alternative to the use of the dashpots assemblies described above. FIG. 7 generally illustrates a friction brake assembly 96 between the buoyancy module 32 and the caisson 10. Two horizontal bars 98 are spaced apart from each other vertically and attached at one end to buoyancy module 32. The opposite ends of bars 98 are attached to braking bar 100 which tapers outwardly from the center. Fixed brake pads 102 are positioned on either side of braking bar and spaced therefrom so as to allow an unrestricted area for normal vertical movement of the buoyancy module 32. However, in the event of a riser failure, brake pads 102 will engage braking bar and cause gradual deceleration of the buoyancy module to prevent equipment damage. The friction braking assembly may be formed from any material that will provide the necessary progressive braking force and withstand the elements. Any number of friction braking assemblies 96 may be used according to the size of the buoyancy module.

Figure 10:
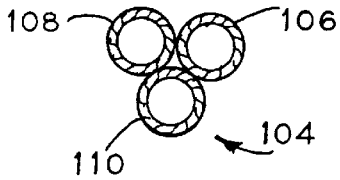
FIG. 10 is a view taken along lines 10—10 of FIG. 9.

FIG. 9 and 10 illustrate a twisted tubing production riser 104 that is formed from three strings of tubing that are rotated as the tubing is being run to cause the three tubes to twist in a braided manner that forms a stable twisted member. This is accomplished by having the ends of the tubes fixed in the marine connector 38 and rotating each tube 106, 108, 110 as they are run simultaneously from the surface. The "braiding" causes the multiple string to act as a single unit and thus will be more flexible than a concentric string. The increased flexibility will reduce the bending moment at the seafloor connection and will also reduce stresses in the vicinity of the keel of caisson 10. Conventional production risers usually are formed from concentric strings with the control function cables being clamped on the outside or strapped to the tubing. With the twisted tubing production riser 104, one string can serve as the flowline, the second string can serve as the annulus, and the third string can be the conduit for the control lines. This provides the advantage of being able to insert and remove control lines as needed through the dedicated string without the necessity of bringing all of the tubing to the surface. It should be understood that the twisted tubing production riser 104 is not limited to a floating caisson but may be used in conjunction with any offshore structure designed to drill for and produce hydrocarbons.

Figure 13:
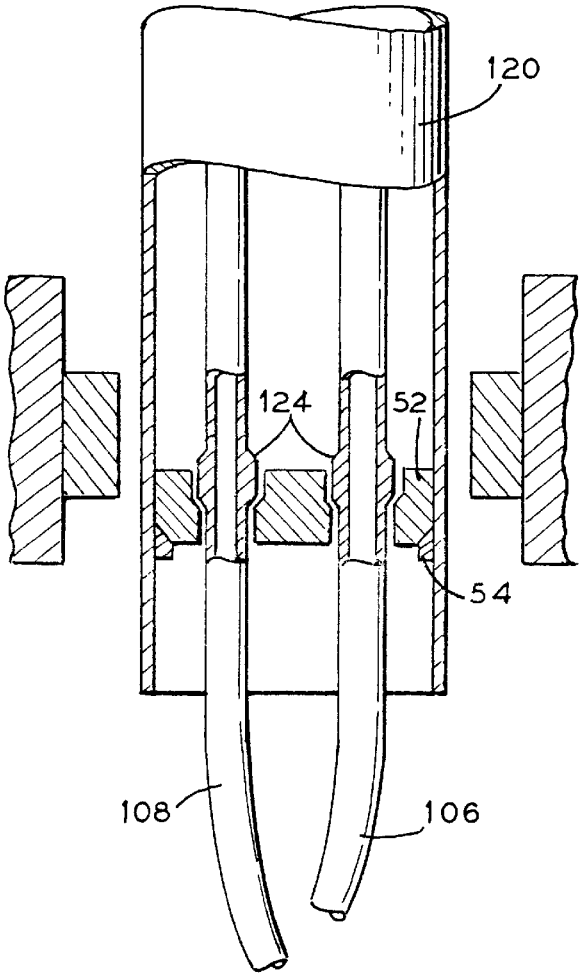
FIG. 13 is a detail side sectional view that illustrates the means for reducing the bending stress on the twisted tubing production riser.
Figure 12:
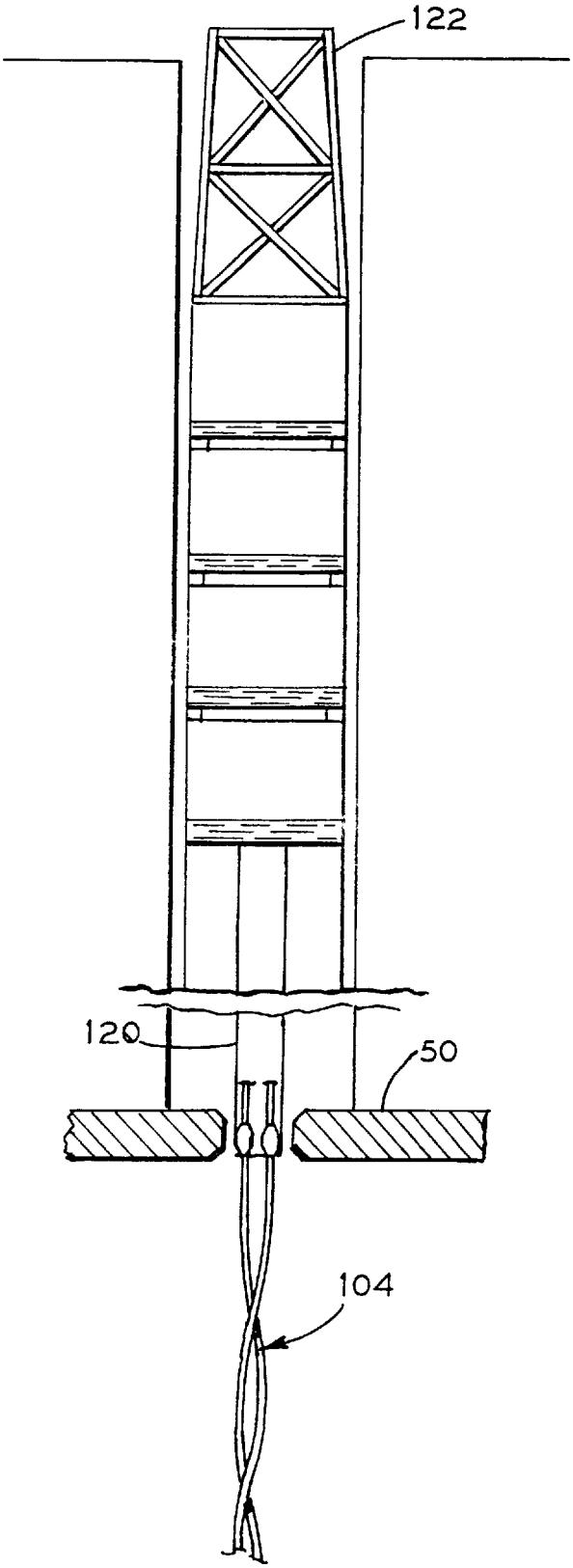
FIG. 12 illustrates the twisted tubing production riser used in conjunction with a buoyancy module.

As illustrated in FIG. 12 and 13, the twisted tubing production riser 104 may also be provided with the stress relief means as described above relative to the drilling risers 28, 30. The lower stem 120 of the buoyancy module 122 for the twisted tubing production riser 104 is provided with a support ring 52 and movable joint 54. As described above, the buoyancy module 122 is contained for limited vertical motion within the caisson 10 and independently supports the twisted tubing production riser 104. The shoulder 124 on each conduit 106, 108, and 110 are supported by the support ring 52 as described above. It should be understood that although the conduit 110 is not shown for ease of illustration, it is included as part of the stress relief arrangement shown.

Figure 14:
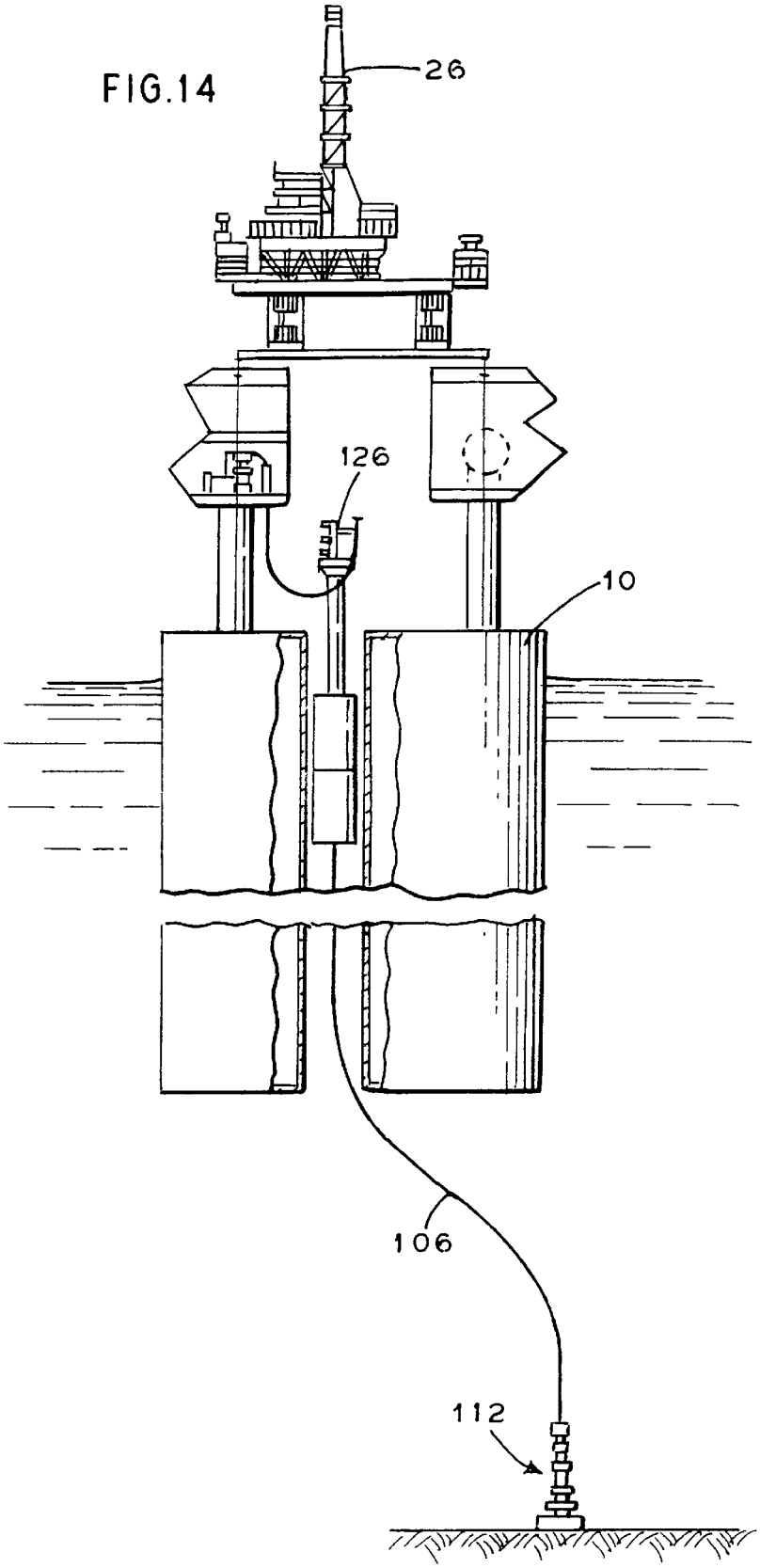
FIG. 14 illustrates the split tree and vertical flowline.
Figure 15:
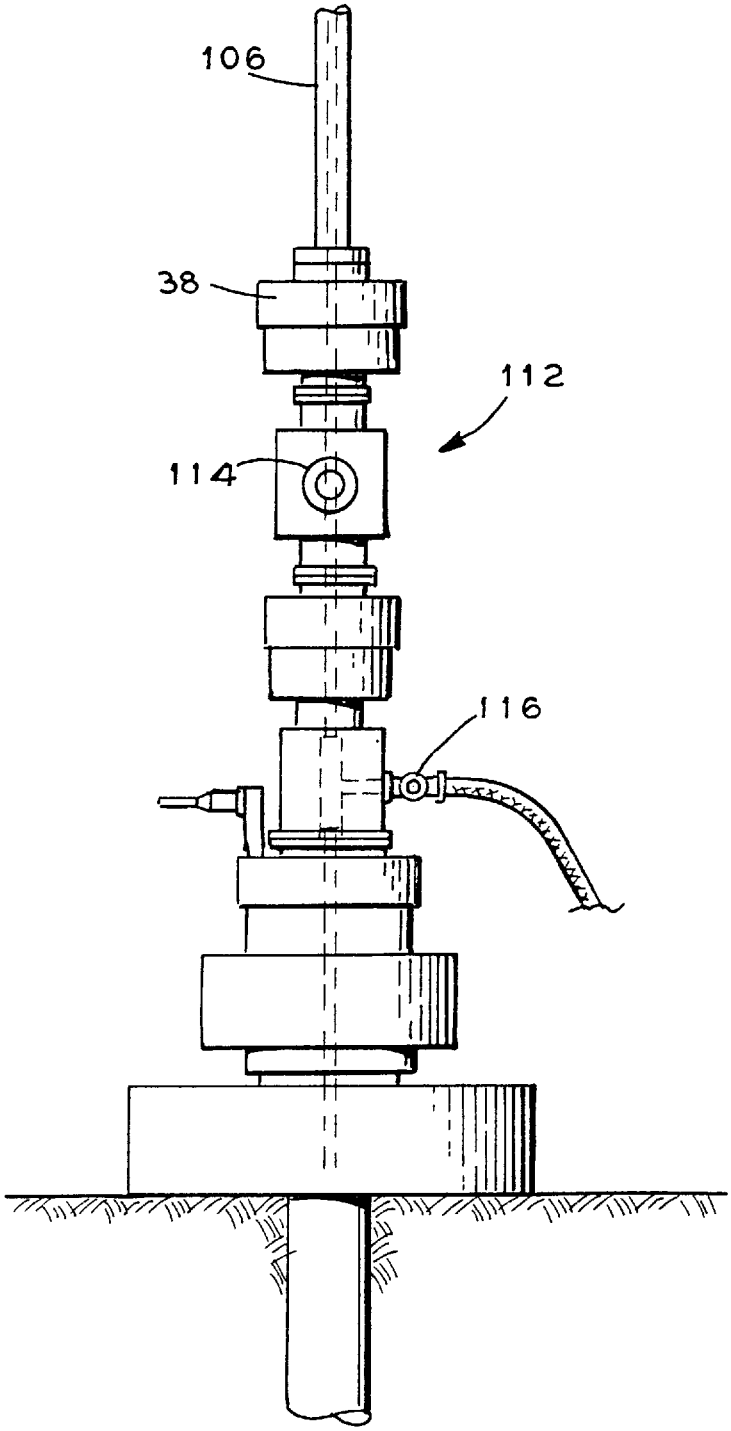
FIG. 15 is an enlarged detail view of the subsea tree and vertical flowline.

FIG. 9 and 15 also illustrate a subsea tree 112 that allows for the use of a vertical flowline production line 106 as opposed to horizontal flowlines that are normally used. The subsea tree 112 meets the requirements for a flowline by having dual master valves 114 and an annulus valve 116 as well as control functions. The need for a wing valve is eliminated since the production goes directly through the vertical riser to the production manifold at the surface. A second tree 126, seen in FIG. 14, is used at the surface for actual fluid control functions such as choking the well, carrying out through-tubing operations, etc. It should be understood that the subsea tree 112 and resulting flowline is not limited to a floating caisson but may be used in conjunction with any offshore structure designed to drill for and produce hydrocarbons.

Figure 11:
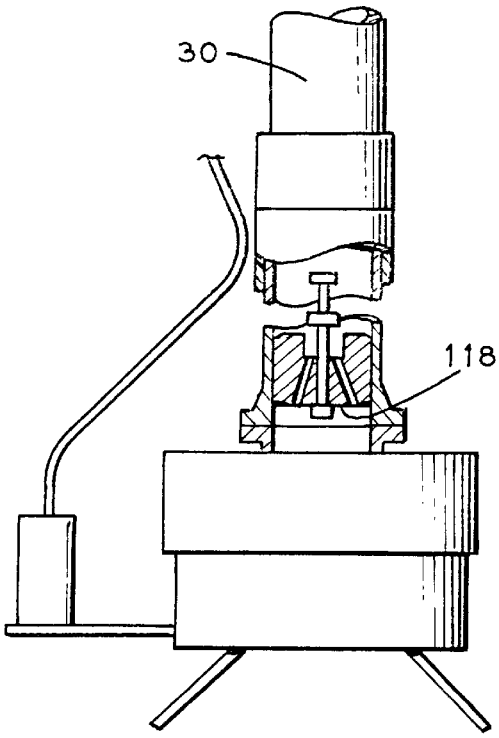
FIG. 11 is a sectional view that illustrates a plug in a riser.

During different stages of well preparation, drilling, and production, it will be necessary to disconnect one type of riser from a well head and attach a different type of riser, such as when changing from the low pressure drilling riser to the high pressure drilling riser. Since one of the purposes of the use of multiple risers is to save time by eliminating the need to bring the riser currently not in use to the surface, it will be necessary to plug the bottom of the unused riser(s) to retain drilling mud and/or keep sand and sea water out of the riser. This is accomplished by the use of a plug 118 as illustrated in FIG. 11. Plugs of this type are generally known in the art and have bypass ports and a central bypass plug that allows mud in the riser to flow through the plug 118 as it is moved through the riser. The upper portion of the bypass plug includes a conventional overshot to allow a tool run down the riser to grip and open the bypass plug and retrieve the plug 118 up through the riser 30.

An alternative to having two separate drilling risers, with different pressure ratings, in the water at the same time is to run the high pressure drilling riser 28 through the low pressure drilling riser 30 so that the two risers are concentric with each other. This allows both risers to be supported by one buoyancy module 32.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. In an offshore structure designed to drill for and produce hydrocarbons, a vertical flowline, comprising:

a. a subsea tree having dual master valves, an annulus valve, and control functions;

b. a vertical production line in fluid communication with said subsea tree; and c. a surface tree in fluid communication with said vertical production line, said surface tree including fluid control functions.

* * * * *